US010987541B2

(12) United States Patent
Schwarz

(10) Patent No.: US 10,987,541 B2
(45) Date of Patent: Apr. 27, 2021

(54) FOOT EXERCISE BRACE AND BALL DEVICE

(71) Applicant: Ana Karina Schwarz, Wichita, KS (US)

(72) Inventor: Ana Karina Schwarz, Wichita, KS (US)

( * ) Notice: Subject to any disclaimer, the term of this patent is extended or adjusted under 35 U.S.C. 154(b) by 118 days.

(21) Appl. No.: 16/552,794

(22) Filed: Aug. 27, 2019

(65) Prior Publication Data

US 2020/0330823 A1 Oct. 22, 2020

Related U.S. Application Data

(63) Continuation-in-part of application No. 16/386,000, filed on Apr. 16, 2019, now abandoned.

(51) Int. Cl.

| | |
|---|---|
| ***A63B 23/00*** | (2006.01) |
| ***A63B 23/10*** | (2006.01) |
| ***A63B 21/02*** | (2006.01) |
| ***A63B 21/00*** | (2006.01) |
| ***A63B 21/055*** | (2006.01) |
| ***A63B 21/04*** | (2006.01) |

(52) U.S. Cl.

CPC ..... *A63B 23/10* (2013.01); *A63B 21/00058* (2013.01); *A63B 21/028* (2013.01); *A63B 21/0442* (2013.01); *A63B 21/0557* (2013.01); *A63B 21/4013* (2015.10)

(58) Field of Classification Search

CPC ..... A61H 1/0266; A61H 15/00; A61H 2015/0007; A61H 2201/164; A61H 2201/165; A61H 2205/12; A63B 23/10; A63B 21/4013; A63B 21/00058; A63B 21/028; A63B 21/0442; A63B 21/0557

See application file for complete search history.

(56) References Cited

U.S. PATENT DOCUMENTS

| | | | |
|---|---|---|---|
| 5,087,036 | A | 2/1992 | Cooper |
| 5,718,673 | A | 2/1998 | Shipstead |
| 5,897,520 | A | 4/1999 | Greig |
| 6,110,078 | A | 8/2000 | Dyer |
| 8,241,232 | B2 | 8/2012 | Sanders |
| 9,387,108 | B2 | 7/2016 | Darby, II |
| 10,130,549 | B2 | 11/2018 | Balducci |

*Primary Examiner* — Steven O Douglas

(57) ABSTRACT

A universal foot exercise brace and ball device with new and useful characteristics for massaging and rehabilitating the plantar fascia is presented. An adjustable ankle brace surrounding the ankle naturally connects to a curvilinear tongue surface that rests over the top portion of the foot defining a passageway for a shock cord. An upper cord lock subsequently accommodates and sizes the shock cord, which in turn holds a spherical ball designed for massaging the tissues found at the bottom of the foot. Together, all the components of this utilitarian device work as one embodiment and integrated unit leaving the plantar fascia completely unobstructed to be massaged using this new device and method that securely holds a ball in place under the foot while it operates rolling under all sections of the plantar fascia as intended by the user.

4 Claims, 3 Drawing Sheets

ISO (Top Front Left)

Front View

Left View

ISO (Top Front Left)

Front View

Front View – Detail A

FOOT EXERCISE BRACE AND BALL DEVICE

CROSS REFERENCE TO RELATED APPLICATIONS

The present application is a continuation in part of U.S. application Ser. No. 16/386,000 filed Apr. 16, 2019 covering alternative embodiments and improvements over the previous Foot Exercise Brace and Ball Device.

BACKGROUND OF THE INVENTION

1. Field of the Invention

The present invention relates to the field of exercise/massage devices and more specifically to an improved device designed exclusively for massaging and rehabilitating the plantar fascia.

2. Related Art

Plantar fasciitis is a condition that affects the connective tissue supporting the arch of the foot. When inflamed, this tissue causes intense pain in the heel, arch, and overall bottom of the foot. Current studies show that about 90% of people suffering from this ailment will improve their symptoms through a variety of conservative treatment methods that include proper exercise and massage of the plantar fascia. Several devices (splints, arch support socks, and ankle braces) exist directed at treating this particular disorder. Although those methods properly emphasize the use of a static dorsiflexion force of the foot to stretch the plantar fascia, they also fall short at providing a massaging element to treat this area of the body. Conversely, the present invention differs from current conventional art in that it does not include dorsiflexion force of the foot or toes. It merely offers an aid in rehabilitation exercise attributing significance to conditioning the tissue found at the bottom of the foot by applying controlled massage and pressure to all sections of the plantar fascia.

A few solutions aimed at easing the pain associated with plantar fasciitis found in prior art follow:

U.S. Pat. No. 6,110,078 issued to Dyer on Aug. 29, 2000, is a device consisting primarily of two hinged plates with a variable tensioning mechanism. Applied to the foot and lower leg the device provides a progressive stretch for planter fascia, Achilles tendon, and gastrocnemius muscle. Enhancements, comprised of an adjustable toe support, adjustable arch support, and foot strap enable maximization of stretch for various foot types and conditions. A method of setting tension levels allows for application of protocol and, in conjunction with the use of a system to measure angular displacement of the plates, provides a method of evaluating flexibility and flexibility gains of the plantar fascia/Achilles tendon system.

The Dyer stretching device offers tension mechanisms where significance is attributed solely to a progressive stretching of the plantar fascia as opposed to our device where significance is attributed to applying pressure and massage to the plantar fascia.

U.S. Pat. No. 5,087,036 issued to Cooper on Feb. 11, 1992, presents a foot and leg-stretching device wherein the heel, ball and arch of the foot remain flat on a footplate while the toes are inclined upwardly against a selectively position able plate. The device is designed to simultaneously stretch the Achilles tendon cord, arch of the foot and calf muscles.

The Cooper stretching device is not only cumbersome to manufacture and use, but lacks functional design and once again, it does not offer a massaging solution for the bottom of the plantar fascia.

U.S. Pat. No. 8,241,232 B2, issued to Sanders on Aug. 14, 2012 describes a foot pain relief device that provides multiple angles of inclination, directed pressure against the plantar fascia, as well as ease of manufacturing and assembly. A toe strap, which is fastened around the ankle and the toe(s), ensures that the toes are flexed up. This toe flexing tenses the plantar fascia of the foot. A ball strap can be threaded through a hole in a ball and then operatively coupled with the toe strap. When operatively coupled to the toe strap, the ball strap keeps the ball positioned on the bottom of the foot while allowing ball mobility. The mobility of the ball can provide directed pressure on at least one component of the plantar fascia. Notably, the simultaneous combination of tension to the plantar fascia and directed pressure to the component(s) of the plantar fascia can be particularly effective at relieving foot pain.

The Sanders device, presents at least three problems (there maybe more). First, lack of functional design is evident. The user must assemble three parts together in his/her foot in order to use the contraption. Second, there is no mechanism securely attaching the device to the foot and keeping the elements together, therefore, its many parts are certain to fall apart at any given moment. Third, the toe strap and the ball strap operate coupled and held together at the sides with double-sided Velcro (where they touch). However, we know that Velcro is generally used to fasten things in a fixed position as opposed to providing mobility. In sum, the use of this contraption in the manner described by Sanders renders the design useless in providing directional flexibility when rolling the ball under the foot.

U.S. Pat. No. 10,130,549 B2 Issued to Balducci on Nov. 20, 2018 describes a physical therapy ball comprising inner and outer hallow spherical bodies. A web positions the inner spherical body with respect to the outer spherical body to form a gap there between. The gap is filled with a high heat capacity gel. An array of conical sections extends from the outer surface of the outer spherical body to facilitate foot massage.

This device presents one fundamental flaw. It lacks a mechanism for attaching it to any part of the body, thereby making it impossible to control the ball under the foot. In this application, the ball might roll away under a piece of furniture (for example, under the bed) in consequence, the user would have to stop exercising and get down on his/her knees to retrieve the ball. This might happen several times during the exercise session making its use very inconvenient.

As explained above, prior art in this field teach several exercising devices all of which correctly emphasize the need of stretching the plantar fascia; nevertheless, there is still a need for a reliable and functional device that properly emphasizes and delivers an integrated method for massaging and applying proper pressure to the plantar fascia.

In consequence, the primary purpose of the present invention is to deliver a novel exercise device for rehabilitating the plantar fascia with the following demonstrable advantages:

a) An adjustable soft brace with original design characteristics,
b) A new method granting movable flexibility, reliability, and functionality for massaging and reconditioning the plantar fascia,
c) A cost effective exercise solution.

This device, clearly displays evidence of original design characteristics and various advantages for the user. First, the novel configuration of all its parts, built and assembled in conjunction, deliver an integrated unit device that enables easy, fast, and safe application of the device on and off the foot. A second advantage of this device is exemplified by describing a new method or cooperative system presenting original design characteristics of flexibility, reliability, and functionality of use. A third advantage is evident in the simplicity of the design, which allows for a cost effective exercise solution. These three advantages will become more evident in the detailed drawings and description presented down below.

SUMMARY OF THE INVENTION

The present Foot Exercise Brace and Ball Device is a novel three-section system built to operate as a universal integrated unit. Each section illustrating:

Section 1) an ankle brace member, which securely loops and fastens around the ankle of the user.

Section 2) a curvilinear tongue member naturally connected to the brace section resting exactly on the top section of the foot. This tongue section furthermore includes two eyelets designed to interact with two other elements:

a) A cord lock mechanism, and b) An elastic shock cord member threaded through three key points: the eyelets featured on the tongue section of the ankle brace, the cord lock system, and the center axis of a ball.

Section 3) a spherical exercise/massage ball member, which includes an open channel crossing through its central axis.

All these section components, built together as an integrated unit device, deliver a novel foot exercise/massage device and method engineered for the treatment and relief of pain and inflammation caused by plantar fasciitis.

BRIEF DESCRIPTION OF THE DRAWINGS

The accompanying drawings illustrate the present invention.

DETAILED DESCRIPTION OF THE INVENTION

The following description of the invention, discloses illustrative and non-limiting embodiments of specific configurations and components. Accordingly, one skilled in the art will readily recognized that while such embodiments and descriptions are non-limiting examples of the specific features described below, they do provide an exact outlining and understanding of the purpose and matter of the present invention.

Figure 1:
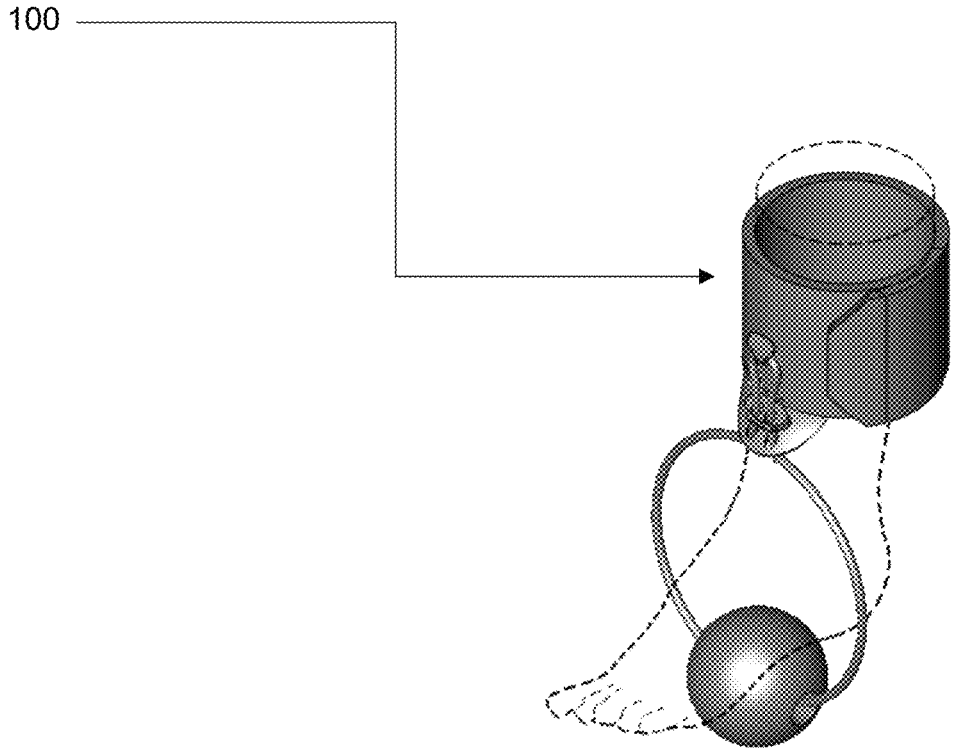
FIGS. 1 and 2 are perspective views of the four sections operating as one integrated and functional unit device.
Figure 2:
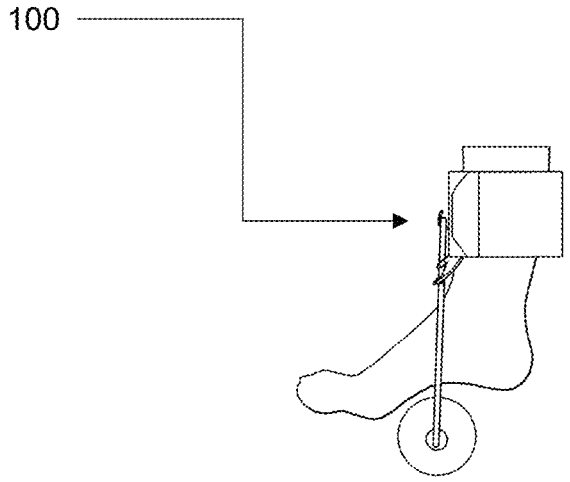

FIG. 1 presents a perspective view of the present foot exercise brace and massage ball embodiment built to operate as a connected unit completely illustrated in FIG. 100, FIG. 2 illustrates a side view of the same device 100 anatomically fitted on a foot and in use. As illustrated in FIGS. 1 and 2, the user easily places either foot inside the ankle brace and fastens the device via a hook and loop securement segment attached to one end of compatible U.B.L Neoprene fabric used on the main body of the brace. Next, he/she safely puts the foot through the elastic shock cord (in between the tongue section and the ball). At this point, the user is ready to begin a controlled rolling motion of the ball under the foot (forward, backward, and lateral) with full flexibility and reliability to cover all aspects of the plantar fascia.

Figure 3:
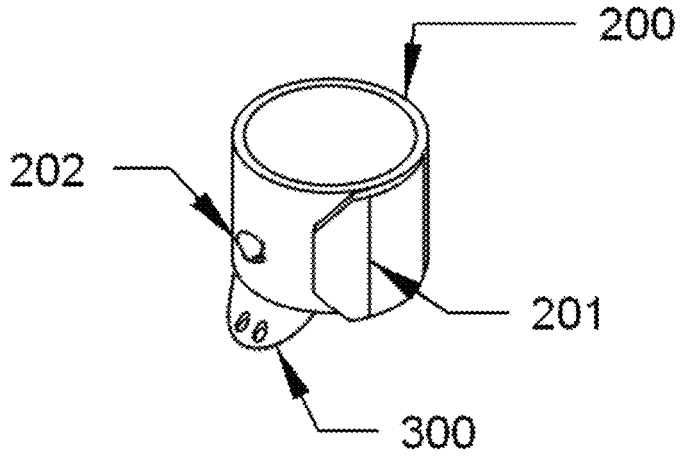
FIGS. 3, 4, and 5 are perspective views of the ankle brace and tongue sections.

FIG. 3 illustrates an ankle brace component 200 constructed using multidirectional breathable material (such as compatible SCR U.B.L Neoprene) of high strength, softness, and elasticity used in this application for maximum comfort in wear. Said ankle brace further includes a hook and loop securement with the male segment attached to one underside end of component 200. Said hook segment designated as component 201 is included for fastening the brace around the ankle; thus, achieving optimal anatomic fit. Said ankle brace component 200, further includes a small Pull-Tab designated as component 202 situated on the front of component 200 and configured to keep out of the way any excess resulting from the elastic shock cord while the device is in use. Said Pull-Tab, being the hook segment of hook and loop; thus, being capable of attaching to component 200.

Figure 4:
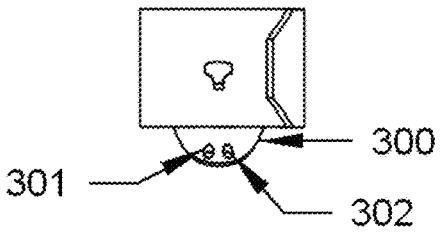

FIG. 4 illustrates a front view of a curvilinear tongue surface component 300 naturally occurring as a continuation of the brace section, thus directly connected to the ankle brace component 200. Said tongue component configured to rest exactly on top of the foot, (in between the superior and inferior extensor retinaculum structure of the foot). Said tongue component 300 configured with two small eyelets designated as components 301 and 302, which specifically provide two orifices for threading and crossing a shock cord from the bottom to the upper side of the tongue surface as seen in FIGS. 1 and 2.

Figure 5:
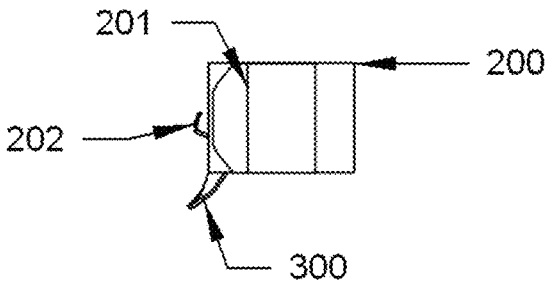
Figure 6:
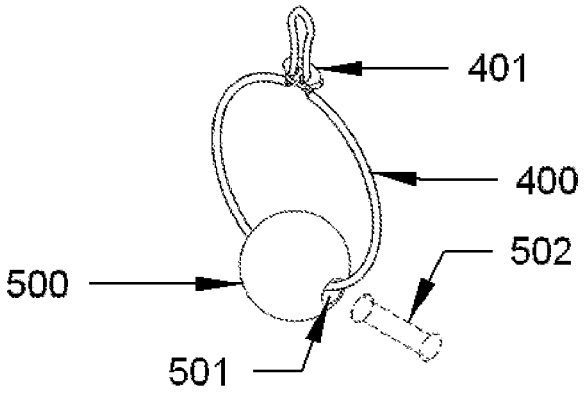
FIGS. 6 and 7 are perspective views of the elastic shock cord, cord lock, and ball sections.

FIG. 5 is a left view illustration of the brace and tongue sections FIG. 6 illustrates an elastic shock cord component 400 designed to be threaded through three key points. First, through the two eyelets described concurrently with the tongue component 300. Second, through a cord lock mechanism designated as component 401 provided as a tightening means for selectively sizing the elastic shock cord to a desired personal length. Third, through the center channel of a ball component 501 (explained below). Furthermore, said elastic shock cord component 400 is configured to provide specific functionality of the massage ball holding it in position under the foot while also allowing maximum flexibility to roll it with directional control (forward, backward, and lateral) against all sections of the plantar fascia as intended by the user.

Figure 7:
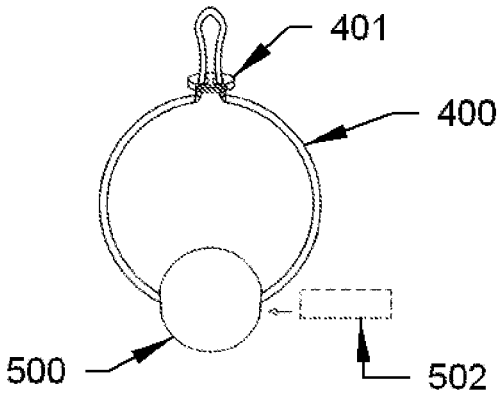

FIG. 7 illustrates an exercise/massage ball component 500 built of EVA foam, a material never before used in a massage application device offering unique characteristics, which generate a dense ball with sufficient softness suitable for applying proper pressure to the plantar fascia. Said ball further comprising a hollow cylindrical channel designated as component 501 occurring from side to side on the center axis of the ball configured to allow unrestricted circulation of the elastic shock cord member 400. This cylindrical channel further includes an optional solid cylinder designated as component 502 (shown in FIGS. 6 and 7 as a phantom view) fused to the inner side of the ball and built to provide structural support to said member 500 thus, effectively avoiding its collapse under the foot.

Figure 7A:
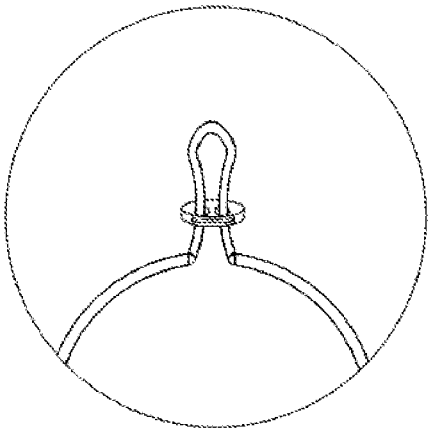
FIG. 7A is a detail view of the interaction between the cord lock and the shock cord.

FIG. 7A is an amplified detail illustration of the elastic shock cord interacting with a cord lock system.

Although reference to specific materials used in the construction of this device precedes; any other methods, processes, and suitable materials (elastic rubber, compatible UBL Neoprene, molded plastic, sports mesh, EVA foam, and others) that prove useful in the manufacturing and overall comfort and fit of this device may be employed without limitations or restrictions.

The invention claimed is:

1. A Foot Exercise Brace and Ball Device engineered for the treatment of plantar fasciitis, comprising:

(a) an adjustable Ankle Brace component designed for receiving the foot of a user formed of multidirectional stretch fabric comprising a curvilinear tongue section integrally extending from the ankle brace component, said ankle brace component further encompassing a hook and loop securement segment sewn to the underside of one terminal end of the ankle brace component so as to anatomically fasten it around the ankle of a user;

(b) a Cord Lock component configured as an adjusting mechanism for threading and sizing an elastic shock cord component through two holes, said cord lock component held loosely in position above the curvilinear tongue section of the brace by function of the elastic shock cord component;

(c) the elastic shock cord component threaded through the cord lock component, the curvilinear tongue section of the brace, and an exercise ball component, said elastic shock cord component cord configured for engaging and retaining the exercise ball component under the foot of the user; and (d) the exercise ball component comprising a hollowed built-in cylindrical channel intersecting the center axis of the ball configured to allow unrestricted circulation of the elastic shock cord component, said cylindrical channel further including a solid yet hollow cylinder fused to an inner part of the ball for preventing its collapse when under the weight of the foot of a user;

wherein the foot exercise brace and ball device is typified in that, all the aforementioned components are constructed for cooperatively engaging with each other to operate as one integrated foot-massaging device.

2. The foot exercise brace and ball device of claim 1, wherein the two holes comprise two eyelets configured for threading and crossing the elastic shock cord component from the bottom to the upper side of the curvilinear tongue.

3. The foot exercise brace and ball device of claim 1, further comprising a Pull-Tab component centrally mounted on the ankle brace component formed of hook and loop segments so as to hold any excess resulting from the elastic shock cord component.

4. The foot exercise brace and ball device of claim 1, wherein the exercise ball component is a substantially spherical ball formed of EVA foam.

* * * * *